United States Patent [19]

Osinga et al.

[11] Patent Number: 4,484,166

[45] Date of Patent: Nov. 20, 1984

[54] COIL SUPPORT FOR AN ELECTROMAGNETIC DEFLECTION UNIT

[75] Inventors: Halbe Osinga; Nicolaas G. Vink; Adriaan J. Groothoff, all of Eindhoven, Netherlands

[73] Assignee: U.S. Philips Corporation, New York, N.Y.

[21] Appl. No.: 519,175

[22] Filed: Aug. 1, 1983

[30] Foreign Application Priority Data

Aug. 9, 1982 [NL] Netherlands ..... 8203133

[51] Int. Cl.[3] ..... H01F 5/02

[52] U.S. Cl. ..... 335/213; 335/210; 313/431

[58] Field of Search ..... 335/210, 212, 213; 313/421, 428, 431

[56] References Cited

U.S. PATENT DOCUMENTS

| | | | |
|---|---|---|---|
| 3,996,542 | 12/1976 | Barkow | 335/213 |
| 4,023,129 | 5/1977 | Kratz et al. | 335/213 X |
| 4,117,432 | 9/1978 | Shizu | 335/213 |
| 4,260,974 | 4/1981 | Nelle | 335/210 X |
| 4,316,166 | 2/1982 | Simmons et al. | 335/213 |

*Primary Examiner*—George Harris

*Attorney, Agent, or Firm*—Thomas A. Briody; William J. Streeter

[57] ABSTRACT

A hollow coil support for an electromagnetic deflection unit adapted to surround a part of a cathode-ray tube, the inside of the support carrying a deflection coil wound directly thereon, the support at each of its respective ends having a slotted annular member with groups of turns longitudinally extending from the slots in one annular member to the slots in the other annular member, and means provided between the ends of the support for locally supporting the longitudinal group of turns such that they are free from engagement with the inner surface of the support.

12 Claims, 13 Drawing Figures

COIL SUPPORT FOR AN ELECTROMAGNETIC DEFLECTION UNIT

The invention relates to an electromagnetic deflection unit for a cathode-ray tube, comprising a hollow support adapted to surround a part of the cathode-ray tube, the inside of the support carrying a deflection coil which is wound directly thereon, the support having at each of its respective ends a slotted annular member, groups of turns of the coil longitudinally extending from the slots in one annular member to the slots in the other annular member.

A deflection unit for deflecting the electron beam(s) which is (are) generated by an electron gun system in a cathode-ray tube of the type having a display screen at one end and an electron gun system at the other end, can be assembled in various manners. In a given construction both the deflection coil for deflection in a horizontal direction (the line coil) and the deflection coil for deflection in a vertical direction (the frame coil) are of the toroidal type and are wound directly onto the magnetic core of the deflection unit. In another construction the two coils are of the saddle type and are not wound directly on the core but are separately wound and then placed on a separate support within the magnetic core. In a further construction the line deflection coil is of the saddle type and is placed on a separate support within the magnetic core, while the frame deflection coil is wound toroidally onto the magnetic core. These different constructions of deflection units are each used in accordance with the particular object for which they are best suitable.

In a conventional deflection unit in which the deflection coil for the horizontal deflection is of the (separately wound) saddle type, the saddle coil is shaped from a conductor which is wound in a metal jig according to a slot winding method and is given the desired shape by means of heat and pressure (see U.S. Pat. No. 3,086,562). The saddle coil thus formed is mounted on a support and placed within the magnetic core of the deflection unit. Saddle coils which in contrast herewith are wound directly on the support of the deflection unit were indeed described in patent literature in the years between 1970 and 1980 but so far they have not been used in practice. A representative description may be found in U.S. Pat. No. 3,895,329. In the deflection unit described in that Specification the magnetic core has slots at each of its ends which are formed either directly in the core material or in respective annular members connected to the ends of the core. Each longitudinal group of turns of the coil extend along the inner surface of the core from the slots at one end towards the slots at the other end. Transverse connecting limbs are produced during the winding process by guiding the wires annularly around the outer surface of the magnetic core and the annular members, respectively, between the respective initial and final slots for each turn.

The longitudinal wires of the turns touch the inner surface of the magnetic core (the support). This is why such a coil is difficult to wind in a reproducible manner because a wire tends to remain in the accidental place where it comes in contact with the substratum. This is a problem in particular with coils which are wound in a number of layers.

Descriptions of deflection units having such directly wound coils are known from patent literature in which the reproducibility problem is tackled by providing the longitudinal wires of the turns in grooves provided in the inner surface of the magnetic core. A representative description may be found in British Patent Specification No. 2,015,146. A disadvantage of this solution is, however, that the direction in which the grooves extend cannot be freely chosen because otherwise the ability to wind the coil is impeded.

The above-mentioned problems are probably the reasons why such directly wound saddle coils have not yet been used in practice.

It is the object of the invention to provide a deflection unit of the kind mentioned in the opening paragraph which can be wound in a more reproducible manner.

The invention provides a deflection unit of the type described in the opening paragraph which is characterized in that provided between the ends the support there comprises means for locally supporting the longitudinal groups of coil turns in such manner that these groups are substantially free from engagement with the inner surface of the support.

The supporting means may comprise a further annular member having slots in its inner circumference through which the longitudinal groups of the coil turns extend. This presents not only the advantage that the wires are away from the supporting surface but moreover presents the advantage that the location of the wires (and hence the field distribution) can be controlled: there is no restriction as to straight-crossing wires, the wires may also extend in a curve—via the slots in the "central" ring. As a result of this the location of the wires of the coil can be freely modulated as a function of the direction along the longitudinal axis in the angular direction and a self-convergent system of coils can be achieved without this requiring auxiliary means in the form of segments of a magnetically permeable material placed in the deflection field. In particular, the longitudinal groups of the coil turns can extend through the slots in the further annular member in such manner that they enclose a concave window. Saddle coils which are wound conventionally in a slot between two mould halves cannot be wound in such manner as to enclose a concave window. A concave window is required to give the deflection field, which is generated by a (frame) deflection coil of the saddle type in planes perpendicular to the longitudinal axis, the pin-cushion-shaped and barrel-shaped variations required for self-convergence.

A further preferred embodiment of the deflection unit in accordance with the invention is characterized in that the coil is formed by a number of spiral-like turns having longitudinal segments which extend oppositely to the inner surface of the support and the ends of which are connected in pairs by transversal connection segments extending over the outer circumference of the support, the transversal segments of the coil at at least one of the ends of the support being divided over at least two areas extending in the circumferential direction.

By dividing the transversal turn segments of a coil over at least two circumferential areas situated so as to be shifted relative to each other in the axial direction, it is possible to accurately adjust the length of the deflection field generated by the coil upon energization, and more in particular the location of the deflection point.

The division of the transversal segments takes place in particular on the side of the deflection unit to be facing the electron gun system of a cathode-ray tube during operation.

The inner surface of the support preferably widens continuously from one end to the other. This has for its advantage that the wire distribution can be more easily made to be reproducible than in an inner surface changing from a cylindrical into a conical shape; it can easily be ensured that the wires remain free from the inner surface.

In order to promote a good locking of the wires during the winding process, it is furthermore of advantage when the slots are provided on the inner circumference of the central ring in such manner as to also extend in the direction of the wire supplied during the winding process. This means that in the case of a deflection coil the longitudinal groups of turns of which define a concave window (frame deflection coil), at least a number of these slots do not extend radially. The extent of deviation from the radial direction is a function of the extent of concavity of the window.

It is possible to distribute the slots over the inner circumference of the further annular member in such manner that longitudinal groups of turns of both the frame coil and the line deflection coil extend through a number of them. During winding, for example, first the frame coil turns and then the line deflection coil turns are laid in the slots. For an optimum degree of filling it is of advantage that a number of slots in the central ring from the inside to the outside have a first variation, which deviates little from the radial variation and have a second variation deviating more considerably from the radial variation. Herewith it can be prevented that the wires are stacked uneconomically, which would be the case when the wires would be guided along straight pegs or straight slots.

The above and other features of the invention will now be described, by way of example, with reference to the accompanying drawings, in which:

FIG. 1 is a perspective view of a direct wound deflection unit according to the invention having two sets of saddle coils, FIG. 2 is a side elevation of such a deflection unit, partly in cross section, which is provided on the neck of a cathode-ray tube, FIG. 3 is a front elevation of the front supporting ring of the deflection unit shown in FIG. 1, FIG. 4 is a cross-sectional view of the supporting ring in FIG. 3, FIG. 5 is a front elevation of the central supporting ring of the deflection unit shown in FIG. 1, FIG. 6 is a front elevation of the rear supporting ring of the deflection unit shown in FIG. 1, FIG. 7 is a sectional view of the supporting ring of FIG. 6, FIG. 8 is a wire distribution chart for the frame deflection coil of the deflection unit of FIG. 1 (solid lines), FIG. 9 is a wire distribution chart for the line deflection coil of the deflection unit shown in FIG. 1 (broken lines), (FIGS. 8 and 9 are not drawn to scale), FIG. 10 is a perspective view of a further direct wound deflection unit according to the invention having one set of saddle coils and one set of toroidally wound coils, FIG. 11 is a front elevation of the front supporting ring of the deflection unit shown in FIG. 10, FIG. 12 is a front elevation of the rear supporting ring of the deflection unit shown in FIG. 10, FIG. 13 is a wire distribution chart for one of the saddle coils and one toroidally wound coil of the deflection unit shown in FIG. 10 wound on the same half of the support.

FIG. 1 shows a deflection unit 1 which comprises a deflection coil support 2 formed by a flared annular magnetic core 3. At the wide end (front) of the core 3 an annular supporting ring 4 manufactured from a synthetic resin is connected to the core. The ring 4 may be formed integral with the core 3. At the narrow end (rear) of the core 3 a supporting ring 5 manufactured from a synthetic resin is connected to the core. Concentrically and within the core 3 an intermediate spacer ring 6 manufactured from a synthetic resin is provided between the supporting rings 4 and 5 and which has a number of slots 7 on its inner face. A front elevation of the intermediate ring 6 (FIG. 5) clearly shows the substantially non-radial positioning of the slots 7, 7', 7'' . . . etc. Coil support 2 carries a first set of saddle coils **8*a*, 8*b* for deflecting in a first (for example vertical) direction electron beams which pass longitudinally through the deflection unit 1, and a second set of saddle coils 9*a*, 9*b*** for deflecting in a second (for example horizontal) direction the said electron beams.

Within the magnet core 3 the wires of the respective coils are stretched between slots in the supporting rings 4 and 5. The ring 4 as will be seen from FIGS. 3 and 4 has flanges 10 and 11 which are divided at various places so as to form posts about which the wires of the coils can be wound. The ring 5 has flanges 12, 13, 14 which are also divided at various places so as to form posts about which the wires of the coils can be wound (see FIGS. 6 and 7). Between the rings 4 and 5 the wires of the coils extend through the appropriate slots 7, 7', 7'', . . . etc. which face inwards on the intermediate ring 6 (FIG. 5) by means of which not only do the wires extend in direction such that they do not touch the inner surface of the magnet core 3 but also that the wires proceeding from one end of the support 2 of the deflection coils to the other may be distributed between different planes (the paths of the wires may exhibit a "bend").

Ring 4 has in total three flanges 10, 11 and 16 between which two circumferential channels 17, 18 are formed (FIG. 4). The channel 17 serves to convey the wires of the coil of one system of deflection coils in a direction transverse to the longitudinal axis of the deflection system (in the present case this is the coil system for the deflection in the horizontal direction) to form a further limb of each coil. The channel 18 similarly serves to convey the wires of the coils of the other deflection coil system again in the transverse direction. (in the present case this is the coil system for the deflection in the vertical direction) to again form further coil limbs.

In corresponding manner, ring 5 has three flanges 12, 13, 14 between which two circumferential channels 19, 20 are formed (FIG. 7). Channel 19 serves to convey the wires of the coils of one deflection coil system again in a transverse direction (in the present case this is the coil system for the deflection in the horizontal direction) and channel 20 serves to similarly convey the wires of the coils of the other deflection coil system also in a transverse direction (in the present case this is the coil system for the deflection in the vertical direction). Thus the limbs are produced for the coil systems at the other end of the support. By providing ring 5 with three circumferential channels, by means of providing a fourth flange 15, it is possible to adjust the length of the coils of the two deflection coil systems independently of each other at the values desired for a given deflection unit-display tube combination. This is important for realizing automatic convergence. Conversely, instead of the two channels 20, 21, ring 5 may be provided with only one single channel of, for example, double width. For separating the wires of a coil at two different levels parallel to the axial direction, for example, a spacer ring may be provided in such a single channel.

The structure described above will be briefly summarized with reference to FIG. 2 which is a diagrammatic side elevation partly in cross section of a deflection unit 1 of the type shown in FIG. 1 when placed around the neck of a display tube 23. It may be seen that a deflection coil support 2 for the above-described direct winding of deflection coils is formed by a flared annular magnetic ring core 3 which at its respective ends comprises a supporting ring 4 and a supporting ring 5 with an intermediate ring 6 placed concentrically on the inside of the core. A frame deflection coil system having wire packets 28 extending along the circumference and a line deflection coil system having wire packets 29 extending along the circumference are directly wound on this assembly in a simple and reproducible manner. An important role is played by the intermediate ring 6 which is shown in detail in FIG. 5.

With reference to FIG. 5 it is to be noted that the slots 7, 7', 7'', . . . etc. which are provided on the inner surface of ring 6 extend in a direction which corresponds to the direction in which the wire is supplied during the winding process. Since, as already noted, the wires do not extend straight from the front to the rear ends of the coil support but are bent, the axial direction of the slots 7, 7', 7'' . . . deviates from the radial directions. It is important that the wires should pass through slots and not against pegs. Although theoretically pegs may also be used to realize a desired wire distribution, a disadvantage in practice is that the wires creep upwards against the pegs (which form one wall) in an unreproducible manner and that a good degree of filling cannot be reached. When for guiding the wires a ring is used having slots (slots have two walls) which extend in the direction of the supplied wire, these disadvantages can be avoided. FIG. 5 furthermore shows that if the wires of coils of two different coil sets have to be guided through one slot, such a slot must have its sides extending in two different directions i and ii, respectively, with respect to the radial direction in order that the wires of the coil of the first set of coils which have to experience a considerable variation of direction can first be guided at the correct angle and the wires of the coil of the second set of coils which have to experience a small variation of direction can then be guided at the correct angle.

FIGS. 8 and 9 show an example of how a wire distribution of a deflection unit which direct wound saddle coil sets may look. The deflection unit in question is destined to form an automatically converging combination with minimum East-West raster distortion for a 90° colour television display tube having a 14 inch display screen.

FIG. 8 shows in particular an angle indication of the wire distribution of one of the two coils of the frame deflection coil set (solid line), namely of the front (A), the center (B) and the rear (C) of the deflection unit. The Figure is not drawn to scale, so that the fact that the deflection unit is flared resulting in the section from 0° to 180° in A in practice being longer than the corresponding section in B and C, respectively, has not been taken into account. From FIG. 8 it will be appreciated that the front supporting ring A of the deflection unit in question has slots in positions defined by the angles 0°, 10°, 20°, 160°, 170° and 180°, the intermediate ring B has slots in positions defined by the angles 30°, 41°, 52°, 30', 64°, 75°, 105°, 116°, 127°, 30', 139° and 150°, and the rear supporting ring C has slots in positions defined by the angles 15°, 30°, 45°, 135°, 150° and 165° for receiving the wires of one of the coils of the frame deflection saddle coil system. The solid lines represent wire bunches each comprising approximately 10 to 20 wires.

The wire bunches of the (frame) deflection coil traverse the front (A) of the deflection coil support via one circumferential channel. This is represented by the solid line 31. On the rear side (C) the wire bunches traverse two circumferential channels. This is represented by the solid lines 32, 32'.

FIG. 9 is similar to FIG. 8, except that the solid lines now represent the direction of the wire bunches each consisting of 5 to 25 wires of one coil of the saddle line deflection coil system which assumes a position rotated over an angle of 90° with respect to the frame deflection coil system of FIG. 8. In this case the angular distribution of the slots over the various supporting rings is also indicated. FIGS. 8 and 9 are representative of the design of a direct wound deflection unit in which wire bunches of both deflection coil systems pass through a number of the slots in the intermediate ring. For example, first the wires of the frame deflection coil system are wound through these slots and then those of the line deflection coil system. The front (A) and on the rear (C) each have a separate circumferential channel is for conveying the wire bunches of the line deflection coil system. These circumferential channels are represented by the broken lines 33 and 34.

The description hereinbefore relates to a deflection unit having two deflection coil systems wound in saddle form. However, a deflection unit according to the invention may also comprise one coil system wound in saddle form and one coil system wound in a toroidal form, for the deflection coil support having slotted front and rear supporting rings and a slotted intermediate ring is equally suitable for winding on it a coil of the saddle type and a coil of the toroidal type. FIG. 10 shows a deflection unit having a directly wound saddle line deflection coil system 36*a*, 36*b* and a directly wound toroidal frame deflection coil system 37*a*, 37*b*. In order to be able to wind the two coils 37*a*, 37*b* of the frame deflection coil system toroidally on the deflection coil support 38 consisting of two parts 35*a* and 35*b*, two times five extra apertures 41 are provided in the flanges of the front supporting ring 39 and two times six extra apertures 42 are provided in the flanges of the rear supporting ring 40, as compared with the supporting rings 4 and 5 of FIG. 1. In each supporting ring the apertures in the various flanges are in-line with each other.

Figure 1:
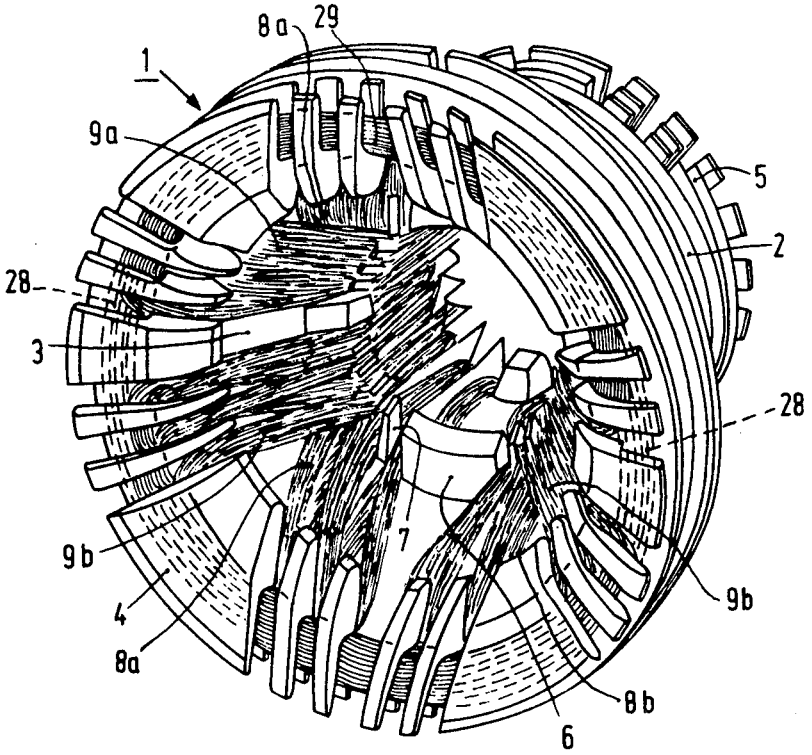
Figure 2:
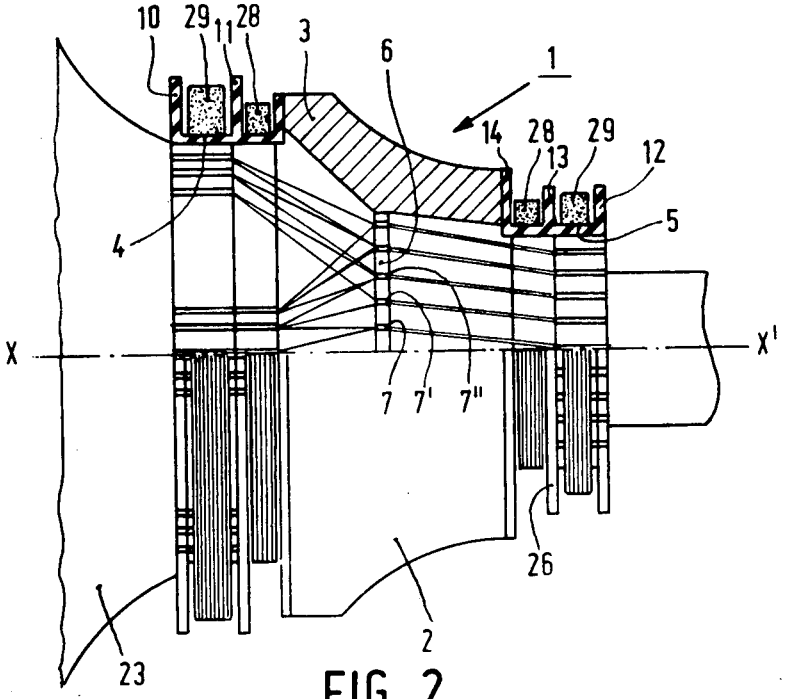
Figure 3:
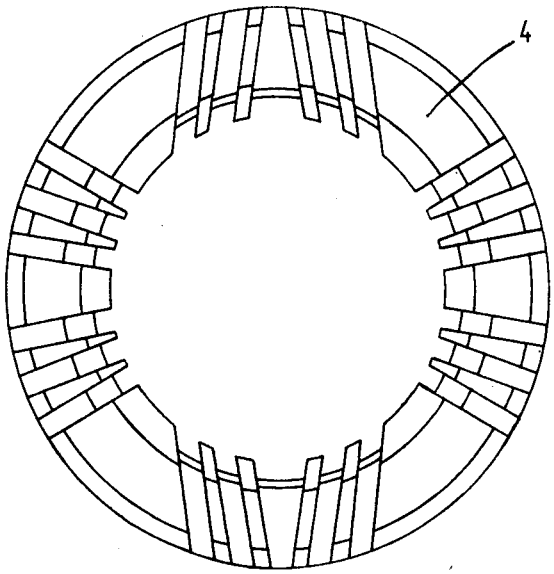
Figure 4:
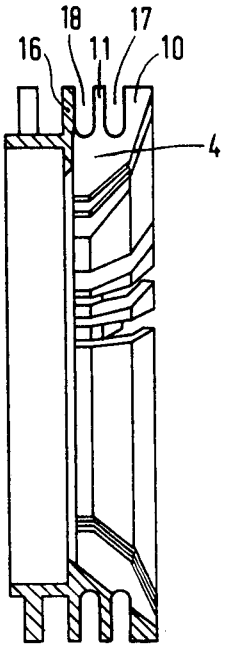
Figure 5:
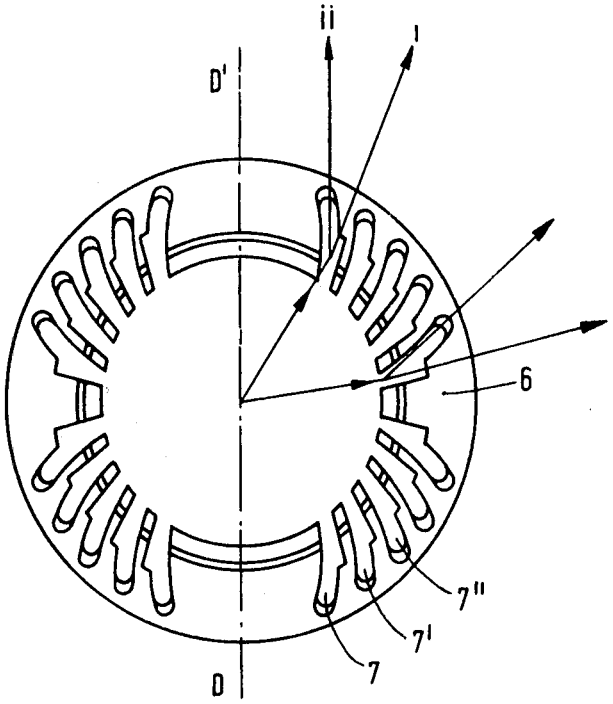
Figure 6:
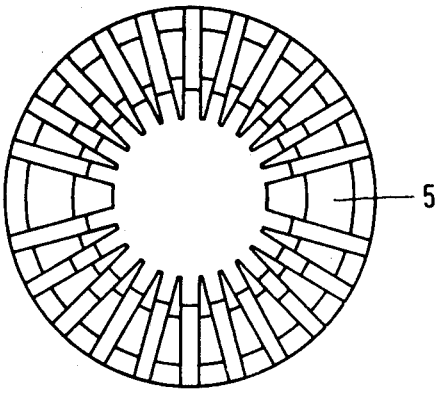
Figure 7:
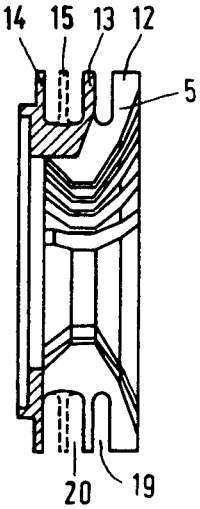
Figure 8:
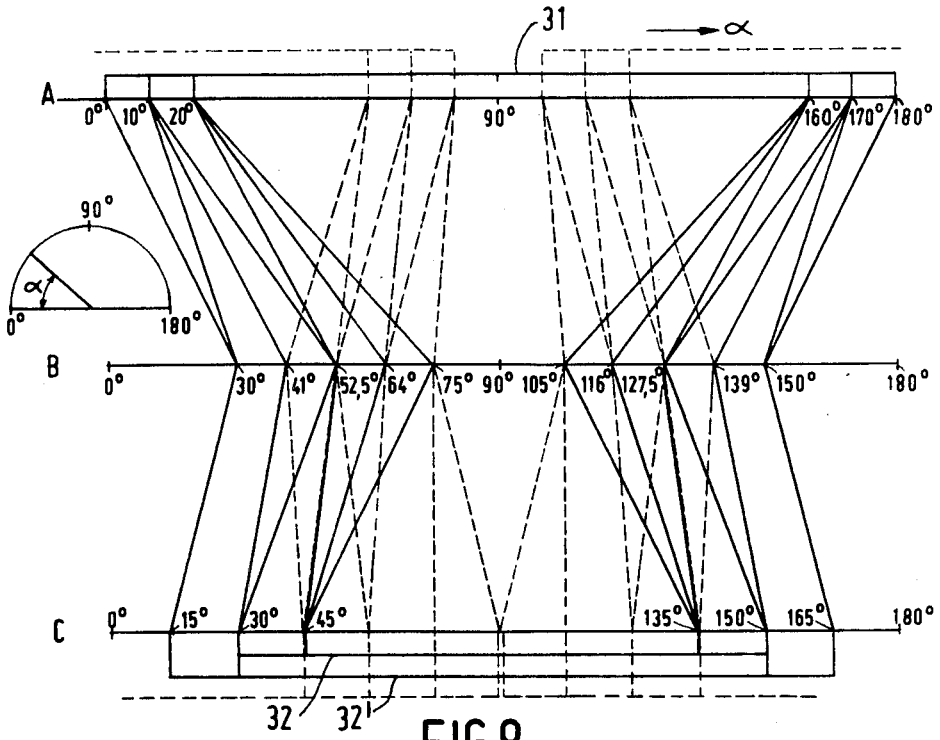
Figure 9:
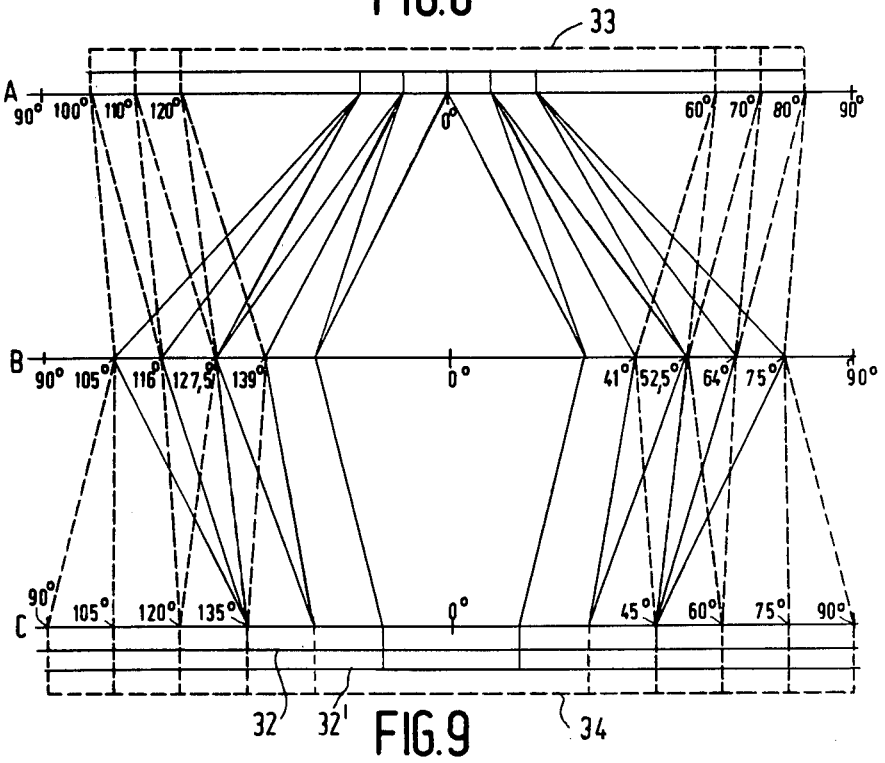
Figure 10:
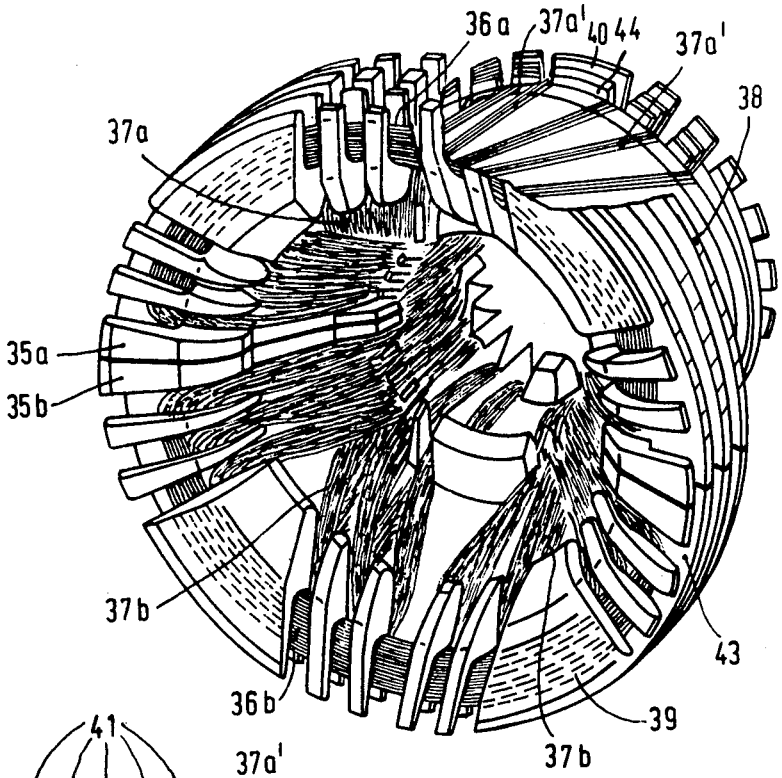
Figure 11:
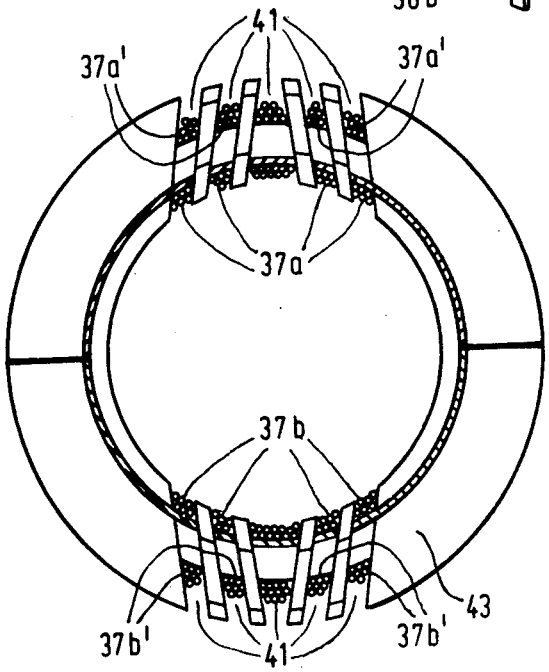
FIG. 11 is an elevation of a sectional view through flange 43 of supporting ring 39. This Figure shows also the cross-section of the wires of the toroidal coil.
Figure 12:
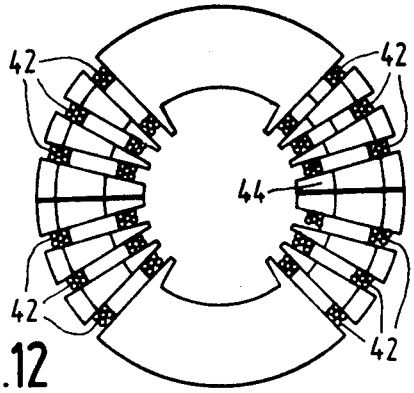
FIG. 12 is an elevation of a sectional view through flange 44 of supporting ring 40.
Figure 13:
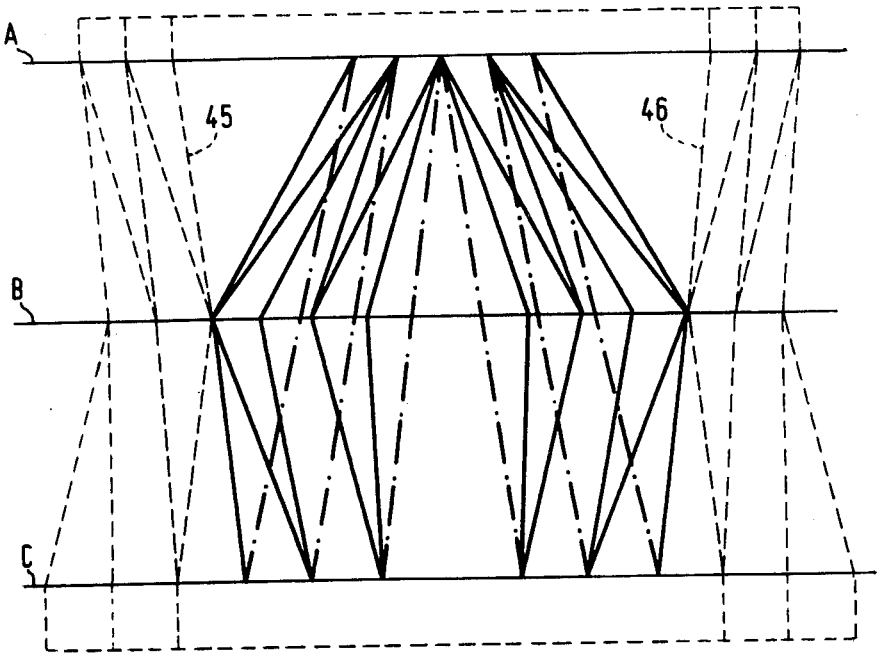

FIG. 13 in a similar manner to FIGS. 8 and 9, shows the distribution of the wire bunches which can be realized in the case of a deflection unit having a directly wound toroidal frame deflection coil system and a directly wound saddle line deflection coil system (a so-called hybrid deflection unit).

The solid lines in FIG. 13 show the direction in which the wire bunches of one coil of the toroidally wound deflection coil system extend. The solid lines indicate the wire bunches situated on the inside of the support and the broken lines indicate the wire bunches situated on the outside of the support. The broken lines indicate the direction in which the wire bunches of one coil of the saddle deflection coil system of such a deflection unit extend. The design shown is such (a small East-West raster distortion being permitted) that one coil can be wound in the window of the other. Such a design facilitates winding, but is not strictly necessary.

The advantage of a hybrid deflection unit in the case in which the deflection coil systems are direct wound is that winding is simplified because winding can be carried out on half deflection coil supports: a line deflection coil and a frame deflection coil being wound on each half deflection coil support 35*a* and 35*b*, respectively.

FIG. 13 also shows a particular variation of the wire bunches of the saddle deflection coil (see the dot-and-dash lines). The facing wire bunches of the left-hand and right-hand packets in fact constitute a concave window. The formation of a concave window is of great importance for a correct distribution of the frame deflection field.

What is claimed is:

1. An electromagnetic deflection unit for a cathode-ray tube, comprising a hollow support adapted to surround a part of the cathode-ray tube, the inside of the support carrying a deflection coil wound directly thereon, the support comprising at each of its respective ends a slotted annular member, groups of turns of the coil longitudinally extending from the slots in one annular member to the slots in the other annular member, and means provided between the ends of the support for locally supporting the longitudinal groups of coil turns in such manner that these groups are free from engagement with the inner surface of the support.

2. A deflection unit as claimed in claim 1 wherein the supporting means comprises an further annular member having slots in its inner circumference through which the longitudinal groups of the coil turns extend.

3. A deflection unit as claimed in claim 2 wherein the longitudinal groups of the coil turns extend through the slots in the further annular member in such manner as to enclose a concave window.

4. A deflection unit as claimed in claim 1 wherein the coil is formed by a number of spiral-like turns having longitudinal segments which extend oppositely to the inner surface of the support and the ends of which are connected in pairs by transversal connection segments extending over the outer circumference of the support, the transversal segments of the coil at at least one of the ends of the support being divided over at least two circumferential areas shifted with respect to each other in the axial direction.

5. A deflection unit as claimed in claim 4 wherein the areas are present on the side of the deflection unit to be facing the electron gun system of a cathode-ray tube during operation.

6. A deflection unit as claimed in claim 2 wherein the slots provided on the inner circumference of the further annular member in such manner as to also extend in the direction of the wire supplied during the winding process.

7. A deflection unit as claimed in claim 2 wherein the longitudinal groups of turns of both the frame deflection coil and the line deflection coil extend through a number of the slots in the further annular member.

8. A deflection unit as claimed in claim 2 wherein a number of the slots in the central member from the inside to the outside have a first variation deviating little from the radial variation and have a second variation deviating more considerably from the radial variation.

9. A deflection unit as claimed in claim 1 wherein said deflection coil comprises a first deflection coil system of the saddle type wound directly on the support and a second deflection coil system of the toroidal type also wound directly on the support.

10. A deflection unit as claimed in claim 9, wherein the support consists of a first and a second half, a coil of the first deflection coil system and a coil of the second deflection coil system being wound directly on each half.

11. A deflection unit as claimed in claim 10, wherein a coil of the first coil system having a window aperture is wound on each support half and a coil of the second coil system is wound in said window aperture.

12. An electromagnetic deflection unit for a cathode-ray tube, comprising a hollow support adapted to surround a part of the cathode-ray tube, the inside of the support carrying a deflection coil wound directly thereon, the support comprising at each of its respective ends a slotted annular member, groups of turns of the coil longitudinally extending from the slots in one annular member to the slots in the other annular member, and means provided between the ends of the support for locally supporting the longitudinal groups of coil turns in such manner that these groups are substantially free from engagement with the inner surface of the support, said supporting means comprising a further annular member having slots in its inner circumference through which the longitudinal groups of the coil turns extend, said coil being formed by a number of spiral-like turns having longitudinal segments which extend oppositely to the inner surface of the support and the ends of which being connected in pairs by transversal connection segments extending over the outer circumference of the support, said transversal segments of said coil and at least one of the ends of said support being divided over at least two circumferential areas shifted with respect to each other in the axial direction.

* * * * *